United States Patent [19]

Lulay et al.

[11] 4,324,095

[45] Apr. 13, 1982

[54] PROCESS FOR PREPARING SLUB YARNS

[75] Inventors: Arthur Lulay, Wilmington, Del.; Charles E. Lynch, Camden, S.C.

[73] Assignee: E. I. Du Pont de Nemours and Company, Wilmington, Del.

[21] Appl. No.: 868,488

[22] Filed: Jan. 11, 1978

[51] Int. Cl.[3] ..... D02G 3/00; D02G 3/34

[52] U.S. Cl. ..... 57/327; 57/209; 57/254; 57/256; 57/317; 428/359; 428/373; 428/399

[58] Field of Search ..... 428/373, 359, 374, 370, 428/364, 399, 400; 57/139, 140 J, 140 BY, 156, 157 R, 209, 206, 327, 317, 254, 256; 19/145.5, 145.7, 98

[56] References Cited

U.S. PATENT DOCUMENTS

| | | | |
|---|---|---|---|
| 3,007,227 | 11/1961 | Moler | 428/359 X |
| 3,038,237 | 6/1962 | Taylor, Jr. | 428/370 |
| 3,038,238 | 6/1962 | Wu | 428/394 X |
| 3,038,239 | 6/1962 | Moulds | 264/171 X |
| 3,038,240 | 6/1962 | Kovarik | 428/371 X |
| 3,039,524 | 6/1962 | Belck et al. | 428/374 |
| 3,092,892 | 6/1963 | Ryan, Jr. et al. | 428/394 X |
| 3,103,098 | 9/1963 | Dyer | 428/399 X |
| 3,161,011 | 12/1964 | Humphreys | 28/281 X |
| 3,350,872 | 11/1967 | Gorrafa | 57/140 BY X |
| 3,429,017 | 2/1969 | Holfeld | 57/140 BY |
| 3,626,684 | 12/1971 | Hovis | 57/140 BY |
| 3,663,676 | 5/1972 | Lulay | 264/168 |
| 3,841,078 | 10/1974 | Hartsog | 428/364 X |

*Primary Examiner*—Lorraine T. Kendell

[57] ABSTRACT

Slub yarns are prepared by adding 10–50% by weight 0.25 to 1 in. long bicomponent acrylic fibers having a density of about 1.0 to 1.17 g/cm$^3$ and an equilibrium crimp reversibility of at least about 20% with staple fibers during or before carding and processing to a slub containing spun yarn in a conventional manner.

11 Claims, 2 Drawing Figures

PROCESS FOR PREPARING SLUB YARNS

This invention relates to an improved process for preparing slub yarns by adding nubs of short bicomponent acrylic fibers to staple fibers during or before carding and processing the resulting fiber blend by conventional methods to produce a slub yarn. When woven or knit into fabrics, the slub yarns produce desirable visual effects.

It is known to produce effect yarns by adjustment of a card to produce a certain amount of rolling of the staple fibers fed which rolls some of the shorter fibers into balls which are not drafted out during carding and subsequent processing. The resulting yarn has a degree of non-uniformity with respect to diameter which can produce a pleasing visual effect when suitably knit or woven into a fabric. It is also known that if yarns containing larger nonuniformities are desired, such yarns are conveniently prepared by adding nubs (knops) of short rayon fibers to staple fibers before or during carding and to process the resulting fiber blends into spun yarns containing slubs. However, these rayon nubs are relatively expensive to produce and have different dyeing characteristics than many synthetic fibers.

Because of their high resistance to degradation on exposure to ultra violet light, acrylic fibers are eminently suited for use in curtains and draperies. Slub yarns of acrylic fibers which are suitable for weaving into fabrics resembling antique satins are highly desired. Such acrylic fibers are also favored for use in knit goods such as sweaters.

SUMMARY OF THE INVENTION

This invention provides an improved process for preparing slub yarns suitable for the preparation of knit and woven fabrics having desirable visual effects.

This invention provides an improved process for producing a slub yarn wherein 10–50% by weight bicomponent acrylic fibers having a hydrophilic component and a less hydrophilic component and having a density of about 1.0 to 1.17 g./cm$^3$ and an equilibrium crimp reversibility of at least about 20% and cut to a length of 0.25 to 1 inch are blended with staple fibers in an amount of 50–90% by weight during or before carding and processed by conventional procedures into a slub containing spun yarn. One component of the bicomponent acrylic fibers is hydrophilic and is preferably comprised of (1) 85–98% by weight acrylonitrile units, (2) 2–10% by weight units of styrene sulfonic acid (o-, m- or p- isomer), 2-acrylamido-2-methylpropane sulfonic acid, allyl sulfonic acid, methallyl sulfonic acid, vinyl sulfonic acid, or their metal, ammonium or amine salts, a vinyl pyridine, vinyl pyrrolidone, acrylamide, methacrylamide, hydroxymethylacrylamide or mixtures thereof, (3) 0 to 13% by weight of units of a comonomer less hydrophilic than units of monomer (2). The other component of the bicomponent fibers is less hydrophilic and preferably contains 0–20% by weight of a polymer as described above and 80–100% by weight polyacrylonitrile. Preferably the less hydrophilic comonomer (3) is methyl acrylate, methyl methacrylate, vinyl acetate, methacrylonitrile or mixtures thereof. The process is preferably carried out on the cotton or worsted spinning systems. The bicomponent fibers preferably have a length of 0.25 inches when used on the cotton system and a length of 0.75 inches when used on the worsted system. In a preferred embodiment of the invention a card sliver containing bicomponent acrylic fibers according to the invention is blended with one or more card slivers which do not contain such bicomponent acrylic fibers. Improved effects can be obtained when the bicomponent acrylic fibers are coated with a high friction finish.

DRAWINGS

DETAILED DESCRIPTION OF THE INVENTION

Figure 1:
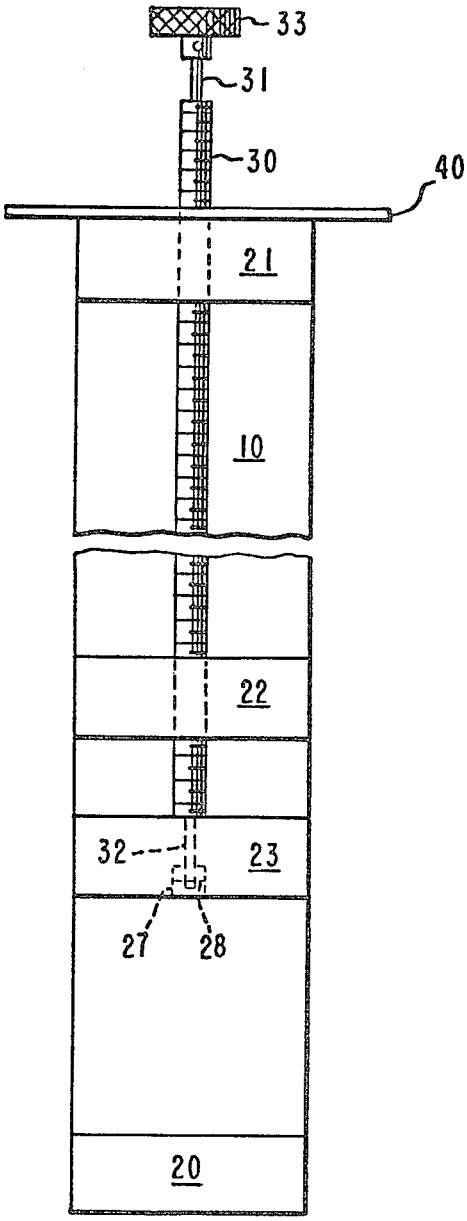
FIG. 1 is a front elevational view of a holder used to measure equilibrium crimp reversibility (ECR).
Figure 2:
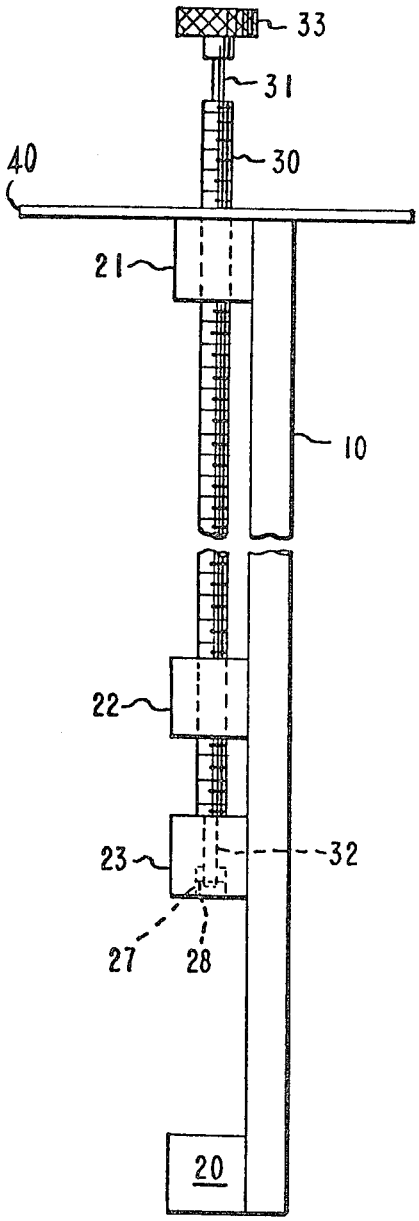
FIG. 2 is a side elevational view of a holder used to measure ECR.

The bicomponent acrylic fibers used in the present invention may be cut from the tow described in copending application No. 681,592 filed Apr. 29, 1976. This application describes tows of highly entangled, continuous, eccentric bicomponent acrylic filaments in which the filaments have a density of 1.0–1.17 g/cm$^3$, an equilibrium crimp reversibility (ECR) of at least about 20% and a filament entanglement value greater than about 12 and less than about 60. The tows are prepared by drying a previously undried tow of continuous acrylic filaments having an eccentric bicomponent structure in which a large difference exists between the hot water swellability of the components of the filaments as indicated by their equilibrium crimp reversibility (ECR). The drying is carried out at a temperature below the hot-wet glass transition temperature ($T_g$) of the fiber polymers until the moisture content of the tow is no more than 3% by weight. The tows may be cut to the desired length by any convenient method such as by using a Lummus cutter.

Alternatively, a wet, never-dried, tow of continuous, eccentric, bicomponent acrylic filaments having an equilibrium crimp reversability (ECR) of at least about 20% may be cut to the desired length and then dried at a temperature below the hot-wet glass transition temperature ($T_g$) of the fiber polymers.

The optimum length of the bicomponent fibers suitable for use in the present invention within the range of 0.25 to 1 inch depends on the system used to prepare the slub yarn. When the cottom system is used, the preferred length of the bicomponent fibers is 0.25 inches. On the other hand, when the worsted system is used, the optimum length of the bicomponent fibers is 0.75 inches.

The bicomponent acrylic fibers have a large difference in the hot water swellability of the two components. Such bicomponent acrylic fibers are described in U.S. Pat. No. 3,092,892 issued June 11, 1963. The difference in hot water swellability of the components making up the bicomponent fibers is measured as equilibrium crimp reversibility (ECR). By "hot" water is meant that the water has a temperature in the region of from about 70° C. up to about the boiling point of water. A higher (ECR) reflects a higher differential between the dry and wet length of the fiber components. While the fibers can have an ECR higher than about 60%, such fibers are not easily prepared on a commercial basis. However, a minimum ECR of about 20% is necessary to obtain the minimum differential in the swellability of the fiber components which will provide adequate crimp development to sufficiently entangle the fibers. Fibers having an ECR of about 20–60% exhibit pronounced differential crimp changes ("squirm") on drying. This arises because the fibers comprise two components in a substantially eccentric relationship in the sense that the cross sections of the components have center points that do not coincide. Such fibers generally develop a pronounced helical crimp on relaxed exposure to conditions that permit relief of stresses imparted during manufacture. Within a most preferred range of ECR of about 30–50%, optimum helical crimp is developed on drying, thus providing optimum fiber entanglement.

The eccentric bicomponent fibers useful in the present invention develop a high helical crimp amplitude, and therefore have a high crimp index. A crimp index of about 10–40, preferably about 20–30, characterizes the fibers useful in the present invention. The higher crimp amplitude is believed to enhance entanglement. At a crimp index of about 20–30, optimum crimp amplitude to provide concomittently optimum entanglement is obtained. The bicomponent fibers useful in the present invention have a crimp frequency of about 2–15 crimps/cm of extended fiber length. When the more hot water swellable component is situated on the inside of the crimp helices, the fiber loses some of its crimp under hot-wet conditions and regains it on drying. The reverse occurs when the more hot water swellable component is on the outside of the crimp helices. Hence, when the more hot water swellable component is on the inside in the dry state, adequate crimp development occurs on drying and fiber has a positive ECR.

Hot water swellability is enhanced by incorporating in the bicomponent fiber polymers units of ionizable monomers which confer dye receptivity to the polymers as illustrated in Taylor U.S. Pat. Nos. 3,038,237 and 3,039,524. Non-ionic monomers that confer hot water swellability to the fiber components include acrylamide, methacrylamide and the betaines as illustrated in U.S. Pat. Nos. 3,470,060 and 3,473,998. Blends of an acrylic polymer and a highly hot water swellable polymer can also be used as discussed in U.S. Pat. No. 3,038,239. The composite fibers described in U.S. Pat. No. 3,092,892 are particularly suitable for use in the present invention.

Any two polymeric components disclosed in the patents referred to above which have a substantial difference in hot water swellability can be used to make the eccentric bicomponent acrylic fibers to be used in the present invention with the proviso that the components possess a difference in hot water swellability which provides the fibers with an ECR of at least about 20%, preferably about 20–60%. Two or more polymers may also be employed as one or each of the two components.

Preferred polymers or blends of polymers which can function as the fiber component having lower hot water swellability include those comprising (A) about 80–100% by weight of a polymer comprising about 85–100% by weight of units derived from acrylonitrile and 0 to about 15% by weight of units derived from a monomer copolymerizable with acrylonitrile and which is less hydrophyllic than a monomer of (2) below including methyl acrylate, methyl methacrylate, vinyl acetate, methacrylonitrile and the like and mixtures thereof, and (B) about 20–0% by weight of a polymer comprising (1) about 85–98% by weight of units derived from acrylonitrile, (2) about 2–10% by weight of units derived from one or more of styrene sulfonic acid (o-, m- or p-isomer), 2-acrylamido-2-methylpropane sulfonic acid, allyl sulfonic acid, methallyl sulfonic acid, vinyl sulfonic acid, or their metal, ammonium or amine salts, a vinyl pyridine, such as 2-vinyl pyridine or 2-methyl-5-vinyl pyridine, vinyl pyrrolidone, acrylamide, methacrylamide, hydroxymethylacrylamide and the like and mixtures thereof and (3) 0 to about 13% by weight of units derived from any other copolymerizable monomer known in the art which is less hydrophilic than units of a monomer of (2), including methyl acrylate, methyl methacrylate, vinyl acetate, methacrylonitrile and the like and mixtures thereof.

The bicomponent acrylic fibers prepared as described in the patents mentioned herein reach most of their full helical crimp capability during drying at a temperature below the hot-wet glass transition temperature ($T_g$) of the fiber polymers. Typically, more crimp (than is achieved with high-temperature dried fibers only after boil-off or steaming after-treatments) is developed in the bicomponent fibers useful in the present invention when they are dried at a temperature below the $T_g$ of the fiber polymers, without the need for such after-treatment. However, even higher crimp can be achieved in the low density fibers useful in the present invention by such after-treatment, especially if carried out under little restraint, as when boiling off chips of cut tow. In addition, the density of the dried fibers is strictly dependent on the drying temperature. Generally, temperatures of about 30–80° C., preferably about 50–70° C., are used depending on the polymer structure, the degree of orientation and the kind of treatment to which the undried fibers have been subjected which might change the $T_g$ of the polymer and the filaments. The preferred range provides optimum results in terms of time and cost. At temperatures above the $T_g$ of the fiber polymers, e.g., about 80° C., the water escapes while the fiber is too limp to develop adequate crimp and entanglement, and the fiber structure can compact, resulting in a high density fiber. At a temperature much below about 30° C., the drying operation is commercially undesirable since it requires a very high flow of drying medium and a long hold-up time. Air or any other gas inert to the fibers may be used as the drying medium. On the other hand, a solvent that extracts water may be used or vacuum may be applied.

Additional treatments such as steaming, boil-off and so on may be employed to further optimize the properties of the bicomponent acrylic fibers useful in the present invention.

The short bicomponent acrylic fibers may be added to the other fibers during or before carding. For example, they can be added during opening or during a mixing step. When large slubs are desired, it is advantageous to prepare a sliver containing a higher concentration of the short bicomponent fiber that is ultimately desired and then to blend this sliver with one or more other slivers which do not contain the short bicomponent acrylic fibers suitable for use in the present invention.

The slub yarns are prepared under normal processing conditions on the cotton or worsted systems. Combing is omitted since this would tend to remove the slubs. The bicomponent acrylic fibers may be blended with any staple fibers suitable for processing in the desired system.

TEST METHODS

Equilibrium Crimp Reversability (ECR)

Tows of dried, crimped filaments to be tested are cut to chips of about 10 cm crimped length and the chips are given a relaxed, 30-minute boil-off loosely wrapped in a single thickness of chessecloth. They are dried for 30 minutes in an oven at 70° C.

Fibers are selected randomly from the boiled off and dried chips and mounted in holders designed to measure ECR as illustrated in the Figures in which like numerals refer to the same element. In the figures, holder base 10 is a sheet of black plastic about 3.8 cm wide, 0.6 cm thick and 20 cm long. Three blocks of aluminum 20, 21 and 22 about 1.3 cm square and 3.8 cm long are firmly attached to one face of the base. The first block 20 is attached across the bottom end of base 10. Another block 21, attached across the top end of base 10 is drilled through its center and parallel to the length of base 10 to just allow an 18 cm long, fully threaded rod 30, approximately 0.6 cm in diameter to pass through. The third block 22 is drilled similarly to block 21, except that it is threaded and positioned about 8 cm above bottom block 20. The diameter of rod 30 is reduced on a lathe at each end 31, 32 to about 0.3 cm for a length of about 0.8 cm. A knurled knob 33 is securely attached to end 31. A fourth aluminum block 23 of the same dimensions as the three mounted blocks is movable and is drilled from the center of one face to pass freely end 32 of threaded rod 30. From one face the hole is counterdrilled to give a counterbore 27 of about 0.6 cm diameter and about 0.7 cm depth, leaving a flat bottom. A disc of aluminum 40 about 0.16 cm thick and about 6.3 cm in diameter is drilled through its center to pass the threaded rod and is firmly attached to the top of aluminum block 21 to serve as a hanger for the holder.

The apparatus is assembled by passing the free end of threaded rod 30 through aluminum disc 40 and top block 21, screwing it through threaded block 22, and passing end 32 through the loose block 23 so that it terminates in counterbore 27 where it is secured with compression washer 28, leaving enough clearance to permit free turning of rod 30. By turning knob 33, movable block 23 is positioned approximately 5 cm from bottom block 20.

One end of each of five boiled-off and dried fibers is taped to movable block 23. The other ends are then taped to bottom block 20 after pulling out slack but not crimp, using care to leave about the same crimped length of fibers between the blocks. Holder base 10 is labeled to identify the sample, and movable block 23 is moved down to provide definite slack in the fibers.

When the required number of fibers have been loaded into holders, the required number of the holders are placed for at least 30 minutes in a glass-walled bath of water maintained at 70° C. Movable block 23 of each holder is moved upward to remove slack from the fibers, and the wet crimp therein counted using a cathetometer; each convexity on one side of the fiber is regarded as a crimp.

The holders are removed from the bath; fiber slack is re-established by moving block 23 downward; the holders are placed in a 70° C. oven for about thirty minutes and then stored at room temperature (about 21° C., 65% relative humidity) for 30 minutes. Dry crimps are counted as described above after removing slack.

$$ECR = \frac{(\text{No. of crimps dry} - \text{No. of crimps wet})}{\text{No. of crimps dry}} \times 100\%$$

Determinations on about 100 fibers are required for good reliability.

Density is determined in carbon tetrachloride/heptane density gradient tubes prepared as known in the art. The range from 1.00 to 1.22 g/cc is covered by two tubes (standard 250 ml graduated cylinders). For the first, the following "stock" solutions are prepared from well-dried solvents:

| ml | | |
|---|---|---|
| $CCl_4$ | heptane | Approx. density |
| 27 | 56 | 0.980 |
| 29 | 54 | 1.002 |
| 31 | 52 | 1.023 |
| 33 | 51 | 1.041 |
| 34 | 49 | 1.056 |
| 36 | 47 | 1.077 |
| 38 | 45 | 1.099 |
| 40 | 43 | 1.120 |

The second is prepared from the following "stock" solutions:

| ml | | |
|---|---|---|
| $CCl_4$ | heptane | Approx. density |
| 38 | 45 | 1.099 |
| 40 | 43 | 1.120 |
| 42 | 42 | 1.137 |
| 43 | 40 | 1.153 |
| 45 | 38 | 1.174 |
| 47 | 36 | 1.196 |
| 49 | 34 | 1.217 |
| 51 | 33 | 1.232 |

To prepare the tubes, 30 ml of the densest stock solution is poured into a 250-ml graduate, followed by 30 ml of the next lighter solution, and the others in turn, until 30 ml of each of the solutions has been added. The second and all subsequent additions are made slowly through a pipette, holding the tip near the wall of the cylinder, to avoid mixing. The two cylinders are placed in a water bath controlled at 25°±0.1° C. and clamped securely in a vertical position. The tubes are stoppered except when making additions or removals.

Calibrated glass floats (obtained from Scientific Glass Apparatus Co., Bloomfield, N.J.) selected to have densities spanning the range to be measured are added and allowed to remain in the cylinders during use. A graph calibrating density vs. height is prepared using the calibrated floats.

A small bundle of filaments (<10 filaments) is tied into a loose knot and the ends clipped off. The knot is placed in the tube and allowed to equilibrate at least an hour (the fiber must not touch any solid surface while equilibrating). The position of the knot in the tube is then read at half-hour intervals until two consecutive readings are the same. The density is determined by reading the density corresponding to the stable height from the graph calibrating density vs. height.

EXAMPLE I

This example illustrates worsted system processing of blends of 10% by weight bicomponent acrylic fibers 0.25 and 0.5 inches (0.635 and 12.7 cm.) in length with 54% bicomponent basic dyeable acrylic staple fibers and 36% by weight acid dyeable acrylic fiber. The samples are prepared by hand blending the component fibers in the hopper of a card without attempting to break up the nubs of short bicomponent acrylic fibers into smaller clumps. The components are:

A. 10 Parts—6 dpf (0.67 tex) 0.5 or 0.25 inch (0.635 or 1.27 cm (length bicomponent filaments)

B. 54 Parts—Commercial 6 dpf (0.67 tex) varicut to 4.5–6 inches (11.4–15.2 cm.) length Acrylic bicomponent staple fibers of the differential component swellability type taught in U.S. Pat. No. 3,092,892.

C. 36 Parts—Commercial 8.5 dpf (0.94 tex) varicut to 3–5.5 inches (7.6–14 cm.) length acrylic, acid-dyeable bright, low-crimp, surface modified (for softness) staple fibers of the type disclosed in U.S. Pat. No. 2,891,035 containing 88.8% by weight acrylonitrile, 5.8% by weight methyl acrylate and 5.9% by weight methyl vinylpyridine.

Carding of each on a 72 inch (183 cm.) single-cylinder Davis and Furber Card provided a somewhat clumpy 390 gr. (27,650 tex) sliver which was twice servo pin drafted with 10 ends fed, using 9 pins/inch (3.5 pins/cm.) and twice more pin drafted with 4 ends fed, using 15 pins/inch (6 pins/cm.) to yield a 110 gr. (7800 tex) sliver. A slubber was used to make a 20 gr. (1420 tex) roving with 0.4 twist/inch (0.16/cm.), which was spun on a spinning frame to make 3 items. Item a is made from sliver containing 0.5 inch bicomponent acrylic fibers and items b and c are made using sliver containing 0.25 inch bicomponent acrylic fibers.

| | Worsted Count | twist/ inch (cm.) | Spindle Speed (rpm) | Scott Skein Strength lbs (kg) singles |
|---|---|---|---|---|
| a. | 4/7.5 (4/472 tex) | 3.8 (1.5) | 4000 | 252 (~114) |
| b. | 2/12 (2/148 tex) | 5.3 (2.1) | 4500 | 182 (~83) |
| c. | 2/20 (2/88 tex) | 8.2 (3.2) | 5000 | 106 (~48) |

The fly level and ends down were higher for these items than for uniform-tex yarns, but not prohibitively so.

When these yarns were cross-dyed with a mixture of basic and acid dyes, attractive novelty slub yarns were obtained in which the slubs differed in color from the background.

EXAMPLE II

Worsted System

Following the procedures of Example I, the following were hand weighed and double-blended on an opener.

15 parts of Component A of Example I, 0.5 inches (1.27 cm.) in length 52.5 parts of Component B of Example I 32.5 parts Component C of Example I Carding at 150 lbs./hour (68 kg./hr.) on a Davis and Furber card yielded a 350 gr. (24,850 tex) sliver without excessive static, cylinder loading or fiber fall-out (about 3%).

Drafting in 3 stages first on a Warner and Swazey servo with eight ends fed, using 12 pins/inch (4.7/cm.) then, intermediate and finisher each with 4 ends fed, using 18 pins/inch (7.1/cm.) ran smoothly to give 100 grain (7100 tex) sliver with 6% CV. By comparison, a similar yarn containing 10% by weight rayon nubs instead of component A had a CV, or coefficient of tex variation of 4.5% by weight.

The slubbing operation ran smoothly to give a roving of 13% CV (versus 9.5–10% for a comparable roving using rayon nubs). Spinning was at a 5,000 rpm spindle speed to give a 1/12 worsted count (74 tex) 7 turns per inch yarn of adequate (232 pounds [105 kg] Scott-skein) strength. Performance was judged adequate, although both fly and breaks were somewhat higher than normal. Yarn quality, after plying to 2/12 worsted count (148 tex) was judged acceptable for novelty end uses and gave attractive slub sweaters when cross-dyed as in Example I.

The slubs were significantly larger and longer than those obtained in ordinary cotton-system processing, as were the slubs obtained in the yarns of Example I.

The same blend levels and spinning process was used to evaluate small lots comprising 15% of the 6 dpf (0.67 tex) nubs of component A which differed in length. They were 0.25, 0.5, 0.75 and one inch in length or a blend of 66% 0.5 inch length and 34% one inch length fibers. Textile performance, as measured by efficiency and uniformity of pin drafting, the number of spinning ends down, overall performance in spinning and plying, improved with increasing lengths of the bicomponent fiber. The yarns were evaluated by winding each on a mirror board and rating them in terms of frequency and size of the slubs. The length and frequency of slubs in the yarns increased with increasing bicomponent fiber length in this comparison, but the best balance of spinning performance and acceptable slub appearance (frequency and large size) was realized with 0.75 inch bicomponent fibers. No special advantage was found in use of the blend of nubs of different lengths.

EXAMPLE III

This example illustrates a means to increase the length and thickness of slubs in a yarn using the cotton system. The yarn preparations were based on a blend of 85 parts of a commercial acrylic 3-denier/filament (~0.33 tex), 2-inch (~5 cm.) bright, trilobal staple intended for cotton-system processing to yarns for knitwear and 15 parts of 0.25 inch (~0.6 cm.) 6 denier/filament (~0.67 tex) nubs of this invention blended before picking. They were prepared: I. without modification of the process or equipment; II. after spraying onto the nubs 3% (non-volatiles) of a finish containing the triethanolamine salt of a $C_6$–$C_8$ alcohol partial ester of phosphoric acid, boric acid, diethylene glycol, triethanolamine and a commercial nonionic surfactant to raise the level of fiber-to-fiber friction, without further modification; III. no modification except that a card sliver containing 30% by weight of the 0.25 inch long bicomponent fibers was blended to 15% nubs in drafting. IV. This item is a commercial item with 15% rayon slubs useful in preparing antique satin fabrics, for comparison.

Each 8/1 cotton count (~74 tex) yarn was analyzed on a Uster Classimat. Results are summarized in the Table below, the frequency of slubs per 100,000 yds. (91,400 m) being tabulated in the Classimat manner. In these classifications, the slub length increases from A (≦1.0 cm.) to D (≧4.0 cm.) and slub diameter increases 1 (≦100%–150% larger than base yarn) to 4 (≧400% larger than the base yarn).

| Classi-mat | I Normal | II High-Frict Finish | III High bicomponent Fiber Card Concentration | IV Comparison |
|---|---|---|---|---|
| A-1 | 12,164 | 10,708 | 12,216 | 84,768 |
| A-2 | 884 | 742 | 326 | 17,112 |
| A-3 | 12.1 | 11 | 5 | 356 |
| A-4 | 0 | 6 | 5 | 4 |
| B-1 | 3,325 | 5.089 | 21,856 | 23,725 |
| B-2 | 917 | 1,253 | 4,776 | 21,943 |
| B-3 | 73 | 60 | 109 | 2,220 |
| B-4 | 6 | 11 | 6 | 3 |
| C-1 | 760 | 1,836 | 9,259 | 6,132 |
| C-2 | 314 | 797 | 6,334 | 9,823 |
| C-3 | 48 | 61 | 469 | 2,356 |
| C-4 | 7 | 62 | 46 | 136 |
| D-1 | 72 | 407 | 1,973 | 594 |
| D-2 | 45 | 413 | 3,474 | 1,630 |
| D-3 | 22 | 151 | 2,407 | 590 |
| D-4 | 4 | 112 | 811 | 68 |
| | 18,659 | 21,717 | 50,531 | 171,488 |

It will be noted that the item prepared by diluting a double-concentration sliver at drawing had substantially more slubs per unit length and larger slubs than the item prepared with 15% slubs initially and is a closer approach to the desired slub distribution as evidenced by the commercial sample, especially in the longer lengths characteristic of antique satin.

EXAMPLE IV

In a manner paralleling those of the foregoing examples, two 20/2 cotton count, (~59 tex) 14 Z/7 S yarns were prepared, each comprising 90% of a commercial 2.5 denier/filament (~0.28 tex) semi-dull acrylic staple intended for spinning in the cotton system; one item (4-A) also contained 10% of 0.5 inch (~1.3-cm.) fiber nubs having the composition of component A of Example I and dried at 25° C. to have a density of about 1.14 g/cc and intense helical bicomponent crimp; the second (4-B), containing 10% of 0.5 inch (~1.3 cm) fiber nubs of the same composition dried at 155° C. to have a density of about 1.18 g/cc and only light mechanical crimp (no helical bicomponent crimp developed), is included for comparison to illustrate the poorer results obtained with fiber prepared in this prior art manner.

Uster Classimat data are:

| Class | 4-A | 4-B |
|---|---|---|
| A-1 | 8032 | 318 |
| A-2 | 462 | 24 |
| A-3 | 10 | 2 |
| A-4 | 2 | 2 |
| B-1 | 3289 | 174 |
| B-2 | 771 | 54 |
| B-3 | 26 | 9 |
| B-4 | 3 | 4 |
| C-1 | 896 | 80 |
| C-2 | 314 | 43 |
| C-3 | 24 | 15 |
| C-4 | 7 | 4 |
| D-1 | 143 | 23 |
| D-2 | 60 | 25 |
| D-3 | 13 | 20 |
| D-4 | 11 | 9 |
| | 14,063 | 806 |

The bicomponent nubs of this invention offer substantial advantages over those currently available. An important consideration, of course, is their lower cost based on no need for special processing before incorporation into the base fiber. Special effects can also be obtained more economically because the nubs are more highly basic dyeable than ordinary acrylic fiber, and normal basic piece-dyeing procedures will give tone-on-tone effects in acrylic yarns containing slubs derived from the nubs of this invention. Uniform or union dyeing is still within the capability of one skilled in the dyeing art, however, and this is an important aspect of the overall versatility of these nubs.

The acrylic yarns comprising slubs derived from the nubs of this invention have utility in a variety of applications. Of particular importance are curtains and drapery fabric which are outstandingly durable due to the excellent sunlight resistance of acrylic fibers generally. Others include upholstery, bedding, napery, and apparel fabrics.

We claim:

1. Process for producing a slub yarn wherein 10–50% by weight bicomponent acrylic fibers having a hydrophilic component and a less hydrophilic component and having a density of about 1.0 to 1.17 g/cm$^3$ and an equilibrium crimp reversibility of at least about 20% and cut to a length of 0.25 to 1 inch are blended with staple fibers in an amount of 50–90% by weight during or before carding and processed by conventional procedures into a slub containing spun yarn.

2. Process of claim 1 wherein the hydrophilic component is comprised of (1) 85–90% by weight acrylonitrile units, (2) 2–10% by weight units of styrene sulfonic acid (o, m or p isomer), 2-acrylamido-2-methylpropane sulfonic acid, allylsulfonic acid, methallylsulfonic acid, vinyl sulfonic acid, or their metal, ammonium or amine salts, a vinylpyridine, vinyl pyrrolidone, acrylamide, methacrylamide, hydroxymethylacrylamide or mixtures thereof (3) 0 to 13% by weight of units of a comonomer less hydrophilic than units of monomer (2).

3. Process of claim 2 wherein the less hydrophilic comonomer (3) is methyl acrylate, methyl methacrylate, vinyl acetate, methacrylonitrile or mixtures thereof.

4. Process of claim 2 wherein the less hydrophilic component of the bicomponent fibers contains 0–20% by weight of a polymer containing (1) 85–98% by weight acrylonitrile units (2) 2–10% by weight units of styrene sulfonic acid (o-, m- or p-isomer), 2-acrylamido-2-methylpropane sulfonic acid, allyl sulfonic acid, methallyl sulfonic acid, vinyl sulfonic acid or their metal, ammonium or amine salts, a vinyl pyridine, vinyl pyrrolidone, acrylamide, methacrylamide, hydroxymethlacrylamide or mixture thereof and (3) 0–13% by weight units of a comonomer less hydrophilic than units of monomer (2) and 80–100% by weight polyacrylonitrile.

5. Process of claim 4 wherein the less hydrophilic comonomer (3) is methyl acrylate, methyl methacrylate, vinyl acetate, methacrylonitrile or mixtures thereof.

6. Process of claim 1 wherein the process is carried out on the worsted system.

7. Process of claim 1 wherein the process is carried out on the cotton system.

8. Process of claim 6 wherein the bicomponent fibers are about 0.75 inches long.

9. Process of claim 7 wherein the bicomponent fibers are about 0.25 inches long.

10. Process of claim 1 wherein a card sliver containing bicomponent acrylic fibers according to claim 1 is blended with one or more card slivers which do not contain such bicomponent fibers.

11. Process of claim 1 wherein the bicomponent acrylic fibers are coated with a high friction finish.

* * * * *